US005398378A

United States Patent [19]

Lin

[11] Patent Number: 5,398,378

[45] Date of Patent: Mar. 21, 1995

[54] HINGE HAVING AN AUTOMATIC RECOVERY MECHANISM

[76] Inventor: Chi-Chung Lin, 58, Ma Yuan West St., Taichung, Taiwan, Prov. of China

[21] Appl. No.: 102,480

[22] Filed: Jul. 2, 1993

[51] Int. Cl.[6] ..... E05F 1/02

[52] U.S. Cl. ..... 16/303; 16/330

[58] Field of Search ..... 16/303, 304, 305, 306, 16/307, 329, 330, 284, 277

[56] References Cited

U.S. PATENT DOCUMENTS

| | | | |
|---|---|---|---|
| 1,078,002 | 11/1913 | Schrey | 16/330 |
| 1,440,713 | 1/1923 | Ausbourne | 16/330 |
| 2,097,651 | 11/1937 | Stangeland | 16/330 |
| 3,074,101 | 1/1963 | Hideyoshi | 16/303 |
| 3,518,716 | 7/1970 | Larson | 16/284 |
| 4,215,449 | 8/1980 | Loikitz | 16/303 |
| 4,485,522 | 12/1984 | Chen | 16/303 |

*Primary Examiner*—P. Austin Bradley
*Assistant Examiner*—Chuck Y. Mah

[57] ABSTRACT

A hinge includes a housing, a barrel rotatably engaged in the housing, a shaft extended in the housing and the barrel, two rings engaged on the shaft and movable along the shaft, springs engaged on the shaft for biasing the rings toward each other, one of the rings has a pair of helical surfaces, and the other ring has two projections for slidably engaging with the helical surfaces. The rings are separated from each other to compress the springs when the door is opened, and the rings are forced toward each other by the springs.

1 Claim, 2 Drawing Sheets

HINGE HAVING AN AUTOMATIC RECOVERY MECHANISM

BACKGROUND OF THE INVENTION

1. Field of the Invention

The present invention relates to a hinge, and more particularly to a hinge having an automatic recovery mechanism.

2. Description of the Prior Art

Typical hinges comprise a pair of flanges fixed to the wall and the door respectively, and a spring engaged between the wall and the door for recovering the door. However, the rotating speed of the door caused by the spring is so fast that the users may be hit or stricken by the door inadvertently.

The present invention has arisen to mitigate and/or obviate the afore-described disadvantages of the conventional hinges.

SUMMARY OF THE INVENTION

The primary objective of the present invention is to provide a hinge which includes an automatic recovery mechanism for recovering the door slowly.

In accordance with one aspect of the invention, there is provided a hinge comprising a housing having a notch formed in a middle portion thereof, a first ear extended from the housing, a barrel engaged in the notch of the housing, a second ear extended from the barrel, a shaft extended in the housing and the barrel and including a first end fixed to the housing, a sleeve secured on the first end of the housing, a wheel secured on a second end of the shaft, a first ring and a second ring engaged on the shaft and movable along the shaft, means biased between the first ring and the sleeve in order to bias the first ring toward the second ring, means biased between the second ring and the wheel in order to bias the second ring toward the first ring, the first ring including a pair of helical surfaces formed therein, the second ring including two projections formed thereon and slidably engaged with the helical surfaces respectively. The first ring and the second ring are separated from each other in order to compress the biasing means when the second ring rotates relative to the first ring and when the door is opened, and the first ring and the second ring are forced toward each other by the biasing means when the door is opened and is released, the door is recovery automatically and slowly such that the users will not be stricken by the door.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
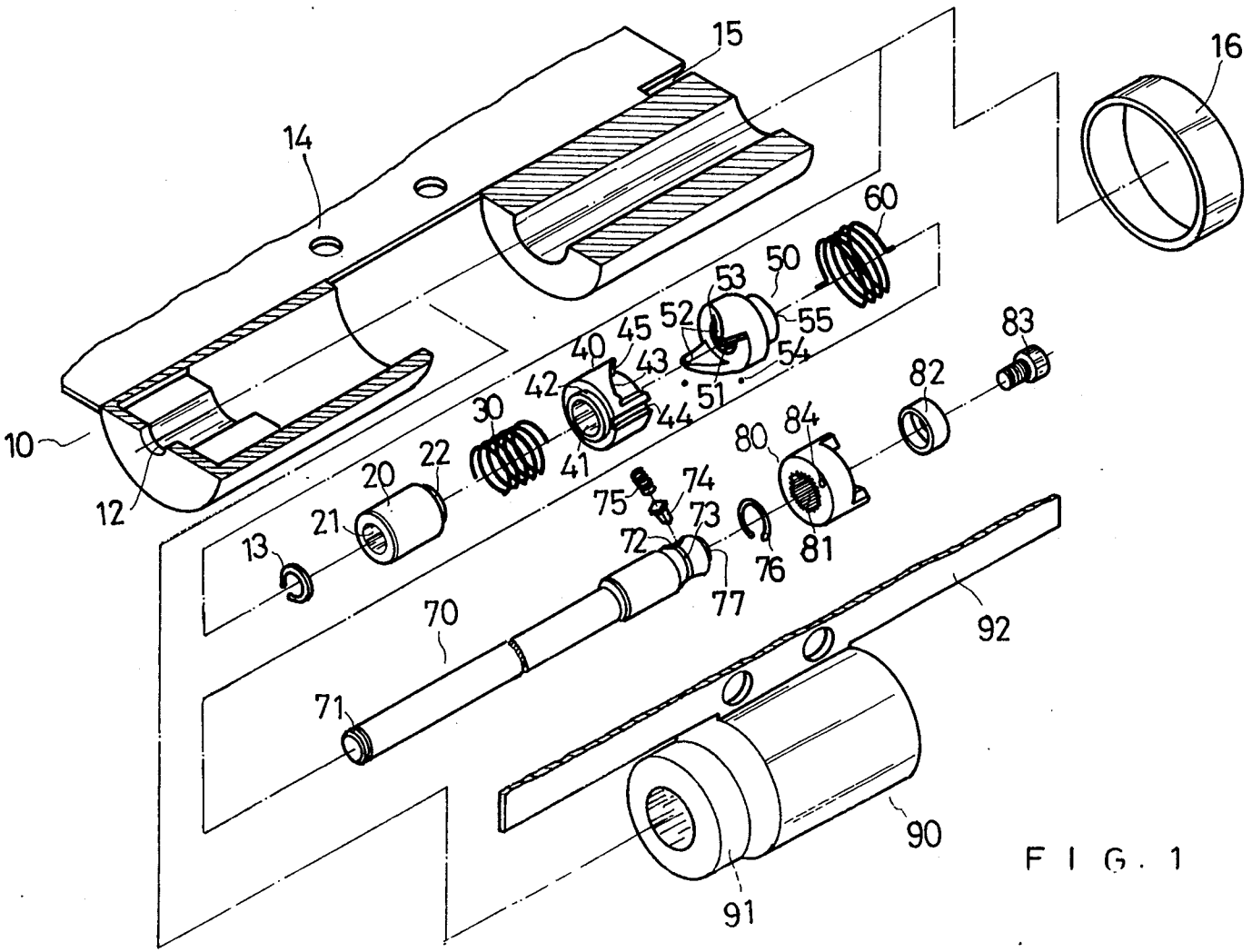
FIG. 1 is an exploded view of a hinge.
Figure 2:
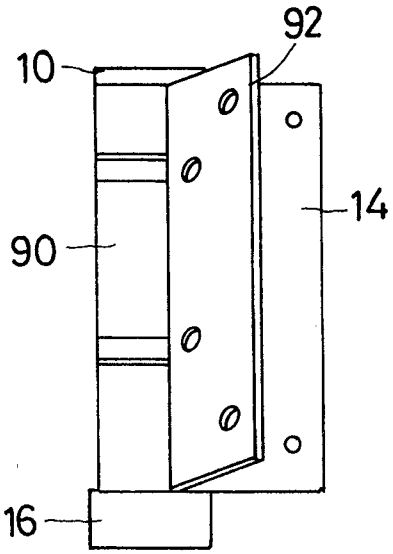
FIG. 2 is a perspective view of the hinge.

Referring to the drawings, a hinge in accordance with the present invention comprises a housing 10 including a bore 12 formed therethrough, a notch formed in the middle portion for receiving a barrel 90, an ear 14 extended from the housing 10 for fixing the housing 10 to the door (not shown), the ear 14 has a slot 15 formed therein and located close to the housing 10. A shaft 70 includes one end extended outward through the aperture 12 of the housing 10 and fixed to the housing by such as force-fitted engagement, and a clamping ring 13 further fixing the shaft 70 to the housing, in which the clamping ring 13 is engaged in the outer thread 71 formed in one end of the shaft 70 and is engaged with the housing 10 so that the shaft is fixed to the housing 10 and rotated in concert with the housing 10. A sleeve 20 has a bore 21 formed therein for engaging with the shaft 70 and has a shoulder 22 formed in one end thereof. The barrel 90 includes a shoulder 91 formed therein for engaging with the housing 10 in a conventional way and includes an ear 92 extended therefrom for fixing the barrel 90 to the wall.

Figure 3:
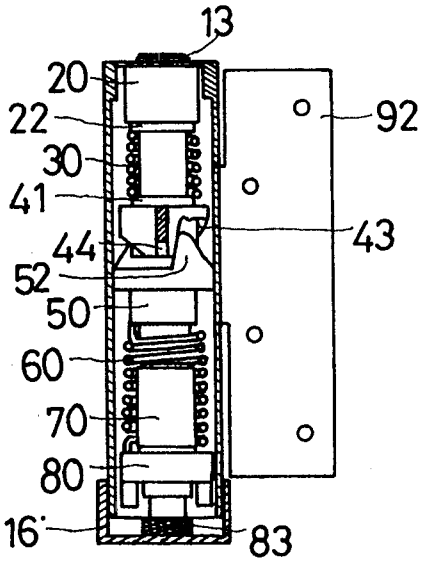
FIG. 3 is a cross sectional view of the hinge, illustrating the interior thereof.

A first ring 40 has a bore 41 for engaging with the shaft 70 and includes a shoulder 42 formed in one end, a spring 30 is engaged between the first ring 40 and the sleeve 20 and engaged with the shoulders 42 and 22 of the first ring and the sleeve respectively, the first ring 40 includes a pair of helical surfaces 43 formed therein and a pair of slots 44 formed between the helical surfaces 43 for slidably engaging with a pair of ribs formed integral in the inner portion of the barrel 90, in which one of the ribs is shown in cross section in FIG. 3, the ribs and the slots 44 are arranged such that the first ring 40 is slidable axially in the barrel 90, each of the helical surfaces 43 includes a flat portion 45 formed in one end and located opposite to the shoulder 42. A second ring 50 includes a bore 51 for slidably engaging on the shaft 70 and a pair of projections 52 extended toward the first ring 40 for engaging with the helical surfaces 43 of the first ring 40, a hole 53 is formed in the tip portion of each of the projections 52 for receiving a ball 54 in order to decrease the friction between the projections 52 and the helical surfaces 43. The second ring 50 includes a hole 55 formed therein for engaging with one end of a spring 60, the spring 60 is also engaged on the shaft 70.

The shaft 70 includes an annular groove 73 formed in the other end opposite to the groove 71, an orifice 72 is formed in the annular groove 73 and extends laterally through the shaft 70, a catch 74 and a spring 75 are received in the orifice 72, a clamping ring 76 is engaged in the annular groove 73 for retaining the catch 74 and the spring 75 within the orifice 72, and the catch 74 is biased outward of the shaft 70 by the spring 75. A ratchet wheel 80 is engaged on the shaft 70 and includes a plurality of teeth 81 formed in the inner peripheral portion thereof for engaging with the catch 74, a cap 82 is engaged with the ratchet wheel 80, and a bolt 83 extends through the cap 82 and the ratchet wheel 80 and threadedly engaged with the screw hole 77 formed in the shaft 70 so as to retain the ratchet wheel 80 and the cap 82 in place, the ratchet wheel 80 includes a hole 84 formed therein for engaging with the other end of the spring 60. The ratchet wheel 80 can be caused to move toward the second ring 50 when the bolt 83 is threaded such that the biasing force of the spring 60 can be adjusted. A cover 16 is further provided to engage with the housing 10 by such as force-fitted engagement and engaged with the slot 15 of the housing 10 so as to enclose the parts and elements of the hinge.

In operation, as shown in FIG. 3, when the door to which the hinge is attached is opened, the housing 10 which is fixed to the door is caused to rotate relative to the barrel 90 which is fixed to the wall, the second ring 50 is rotated relative to the first ring 40 by the shaft 70, the catch 74, the ratchet wheel 80 and the spring 60, the projections 52 of the second ring 50 are thus caused to move along the helical surfaces 43 of the first rings 40 such that the first ring 40 and the second ring 50 are thus caused to move away from each other against the springs 30 and 60, the springs 30 and 60 are thus compressed by the rings 40 and 50 respectively when the rings 40 and 50 are separated from each other. When the door is released or when the ears are released, the projections 52 are caused to move along the helical surfaces 43 of the first ring 40 such that the rings 40, 50 are caused to move toward each other by the springs 30 and 60 and such that the ears can be caused to move toward each other, whereby, the door is automatically recovered. The recovery movement of the door is thus slow down and the users will not be hit or stricken by the door inadvertently.

Accordingly, the hinge includes an automatic recovery mechanism in order to recover the door when the door is opened, the recovery movement of the door can thus be slow down and the users thus will not be hit or stricken by the door inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hinge comprising a housing having a notch formed in a middle portion thereof, a first ear extended from said housing, a barrel engaged in said notch of said housing, a second ear extended from said barrel, a shaft extended in said housing and said barrel and including a first end fixed to said housing, a sleeve secured on said first end of said housing, a wheel secured on a second end of said shaft, a first ring and a second ring engaged on said shaft and movable along said shaft, said first ring slidably coupled to said barrel and rotated in concert with said barrel, a first biasing means biased between said first ring and said sleeve in order to bias said first ring toward said second ring, a second biasing means biased between said second ring and said wheel in order to bias said second ring toward said first ring and securing said second ring to said wheel such that said second ring and said wheel rotate in concert, said first ring including a pair of helical surfaces formed therein, said second ring including two projections formed thereon and slidably engaged with said helical surfaces respectively, said first ring and said second ring moving away from each other in order to compress said biasing means when said second ring rotates relative to said first ring and when said housing is rotated relative to said barrel, and said first ring and said second ring being forced toward each other by said biasing means.

* * * * *